United States Patent [19]

Myers et al.

[11] Patent Number: 4,974,797

[45] Date of Patent: Dec. 4, 1990

[54] HOT BEARING SIMULATOR

[75] Inventors: Larry F. Myers, Altoona; Douglas B. Tharp, Exton; Ralph H. Holl, Hollidaysburg, all of Pa.

[73] Assignee: Consolidated Rail Corporation, Philadelphia, Pa.

[21] Appl. No.: 396,951

[22] Filed: Aug. 22, 1989

Related U.S. Application Data

[63] Continuation of Ser. No. 169,864, Mar. 17, 1988, Pat. No. 4,878,437.

[51] Int. Cl.[5] ..... B61L 3/00

[52] U.S. Cl. ..... 246/169 A; 105/451

[58] Field of Search ..... 246/169 A; 105/451

[56] References Cited

U.S. PATENT DOCUMENTS 4,878,437 11/1989 Myers et al. ..... 105/451

*Primary Examiner*—Joseph F. Peters, Jr.
*Assistant Examiner*—Virna Lissi Mojica
*Attorney, Agent, or Firm*—Woodcock Washburn Kurtz Mackiewicz & Norris

[57] ABSTRACT

A hot bearing simulator is provided for verifying the proper operation of hot box detectors in a dynamic fashion. The hot bearing simulator employs a temperature controller and heater means associated with various axles of a rolling carriage. The heaters are adjusted such that a hot box detector will be verified to determine if it is able to sense when the absolute temperature of left or right wheel bearings exceeds a first predetermined temperature or, alternatively, when the difference in temperature between a left and right wheel bearing differ by a second predetermined amount.

5 Claims, 3 Drawing Sheets

HOT BEARING SIMULATOR

This is a continuation, of application Ser. No. 169,864, filed Mar. 17, 1988 now U.S. Pat. No. 4,878,437.

BACKGROUND OF THE INVENTION

The present invention is generally directed to the field of "Hot Box Detectors" which are used to determine whether the wheel bearings on railroad rolling stock are over-heating and, in particular, is directed to an improved system for insuring that such hot box detectors are operating properly.

Hot box detectors are well known. Hot box detectors comprise heat sensing scanners which are located at spaced points along railroad tracks. The scanners sense the temperature of wheel bearings of passing railroad equipment and, typically transmit the sensed temperature information to a telemetry unit. At the telemetry unit the sensed wheel bearing temperature is compared against a reference and if the reference temperature is exceeded an alarm is transmitted via the telemetry unit to the locomotive engineer.

Defective wheel bearings on railroad equipment are a particularly important problem. When the maximum operating temperature of a railroad wheel bearing is exceeded the wheel may crack thus causing a derailment. Derailments, in addition to being hazardous to crews and passengers, may also lead to the contamination of the environment due to the spilling of hazardous materials and the like. In order to eliminate and minimize derailments railroads typically employ "hot box detectors".

When a hot box detector senses an over-heated wheel bearing the locomotive engineer is expected to stop the train and determine whether the bearing, is indeed, over-heated. The stoppage of railroad traffic for this reason results in downtime for both freight and passengers. Accordingly, it is important that train stoppages for defective wheel bearings take place only when a defective wheel bearing condition has actually been determined. Conversely, it is important that all hot box detectors along a railroads trackage be operating properly. Defectively operating hot box detectors may permit trains having defective wheel bearings to proceed uninterrupted thus causing derailments and corresponding injuries and property damage.

Verification and maintenance of hot box detector is typically carried out by railroad employees who travel along the track periodically and who stop and verify hot box detectors along the route. Such maintenance and calibration procedures are labor intensive and expensive. More importantly, however, maintenance personnel ar able to check hot box detectors only under static conditions. Hot box detectors may appear to be operating properly under static conditions but may, in fact, fail to detect hot wheel bearings under the dynamic conditions created by passing trains.

It would be desirable to provide an apparatus for maintaining and verifying hot box detectors which monitors the operation of such detectors under dynamic conditions caused by the passage of a load along the railroad track.

Hot box detectors typically fall into two classes, namely rail-mount and ballast-mount types. Rail-mounted hot box detectors are mounted on the rail of a railroad track. Ballast mounted hot box detectors are located in the ballast adjacent the rail. The accuracy of both types of hot box detectors may be affected by the passage of a train along the rail. For this reason, dynamic testing of hot box detectors would be desirable.

One method of maintaining and verifying hot box detectors in a dynamic fashion has been proposed. In the proposed method a rolling railroad car is provided carrying a simulated heat source. The simulated heat source is maintained at a temperature far exceeding the temperature of a defective wheel bearing. As the car with the simulated heat source passes over the hot box detector, the simulated heat source causes the hot box detector to trip if the detector is operating. One problem associated with the proposed method is the fact that the simulated heat source is maintained at a temperature far exceeding the temperature of a defective wheel bearing. If a hot box detector trips when the simulated heat source passes the detector all that may be determined is that the hot box detector will trip. It cannot be determined, however, whether the hot box detector will trip when a defective wheel bearing passes. Another difficulty with the proposed method resides in the fact that the simulated heat source provides no compensation for changes in ambient temperature.

Hot box detectors must detect defective wheel bearings irrespective of changes in ambient temperature. On cold days the differential between ambient and defective bearing temperature is correspondingly larger than the differential on warm days. It would be particularly desirable to provide a means for maintaining and calibrating hot box detectors which compensates for changes in ambient temperature.

It would also be desirable to provide a means and method for maintaining and verifying hot box detectors which was not labor intensive.

It would also be desirable to provide a means and method for maintaining and verifying hot box detectors under dynamic load conditions.

It would also be desirable to provide a means and method of maintaining and verifying hot box detectors which accommodated for both rail mount and ballast mount type detectors.

It would also be desirable to provide a means and method for maintaining and verifying hot box detectors which precisely control the temperature of a hot box simulator irrespective of changes in ambient temperature.

SUMMARY OF THE INVENTION

The foregoing objects are achieved by the present invention which includes an apparatus for dynamically simulating the presence of a hot bearing on railroad rolling stock comprising a moveable carriage. The moveable carriage has at least a first axle. A left heater means is associated with the first axle for simulating a hot bearing o the left side of the axle. Right heater means are also associated with the first axle for simulating a hot bearing on the right side of the axle. Means are provided for sensing the ambient temperature and means are further provided for controlling the temperature each of the left and right heater means to a first predetermined temperature above ambient. It has been found that the temperature of the left and right heater means should be maintained at approximately 201° F. above ambient.

In accordance with the preferred embodiment of the present invention both the left and right heater means include a first heater for simulating a bearing traveling in the leading direction and a second heater for simulating a bearing traveling in the trailing direction. These first and second heaters are mounted in a position for verifying the proper operation of rail-mounted hot box detectors irrespective of which direction the carriage is traveling with respect to the detectors.

In accordance with still another aspect of the present invention each of the left heater means and right heater means includes a third and fourth heater, respectively. The third heater is provided for simulating a wheel bearing traveling in the leading direction and the fourth heater for simulating a bearing traveling in the trailing direction. These third and fourth heaters are mounted outboard of the first and second heaters for verifying the operation of ballast mounted hot box detectors.

The present invention contemplates the provision of heater means for simulating hot bearings which may be sensed by both rail-mounted and ballast-mounted hot box detectors. Moreover, heaters are provided for simulating hot bearings regardless of whether the carriage is traveling in the leading or trailing direction so far as the line of sight of the hot box detectors is concerned. Utilizing the device of the present invention thus far described, hot box detectors may be verified to insure that such detectors respond when the absolute temperature of a wheel bearing exceeds a first predetermined temperature above ambient.

In accordance with another important aspect of the present invention, the moveable carriage may further include second and third axles. A right heater means is associated with the second axle and the left heater means is associated with the third axle, or vice versa. Also associated with the second and third axles are temperature sensors located on opposite sides of the axles from the heater means. Means are provided for controlling the temperature of the heater means associated with the second and third axles to maintain a second predetermined temperature above ambient. Using this approach hot box detectors may be verified to insure that the hot box detector trips when the differential temperature between a right wheel bearing is a second predetermined temperature above a left wheel bearing and vice versa.

It has been found that when the differential temperature of a left wheel bearing with respect to a right wheel bearing or vice versa exceeds a predetermined amount that such wheel bearing is likely to fail even if the absolute temperature of that wheel bearing is not excessive. Thus the present invention is able to verify the operation of hot box detectors to insure that the detectors trip when either the right of left bearings exceed ambient by a first predetermined amount or whenever the temperature of the left or right bearing differs from the other by a second predetermined amount.

BRIEF DESCRIPTION OF THE DRAWINGS

The present invention will be more fully understood by reference to the accompanying drawing in which.

DETAILED DESCRIPTION OF THE PREFERRED EMBODIMENT

Figure 1:
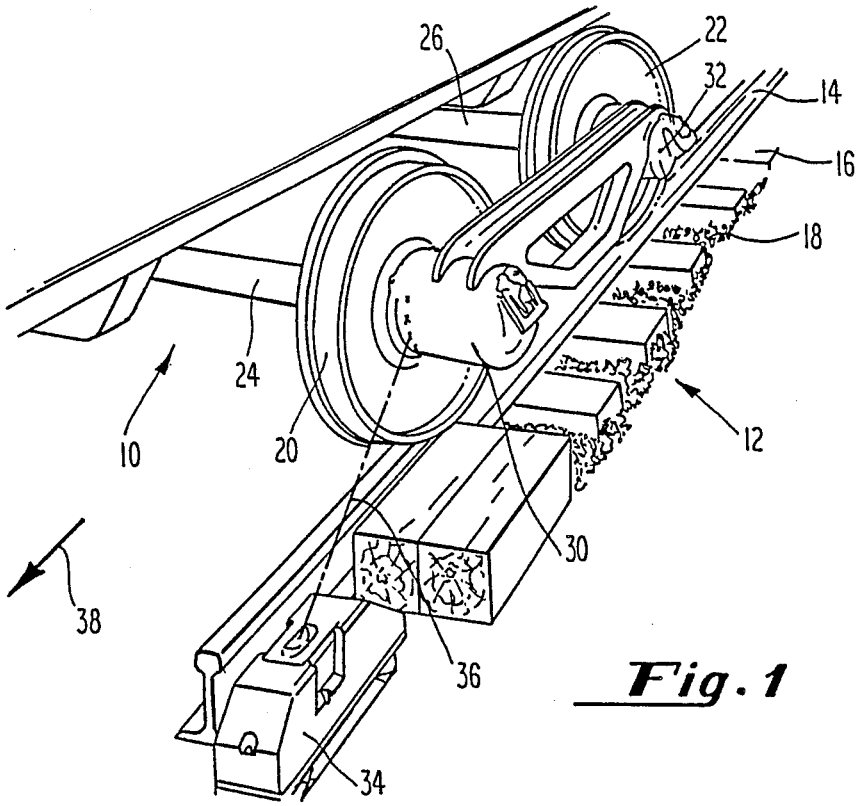
FIG. 1 is a perspective view of the wheel truck of a railroad car, the wheel bearing of which is being sensed by a rail-mounted hot box detector.

Referring now to FIG. 1 the environment in which the present invention is used will be described in detail. As shown in FIG. 1 railroad rolling stock 10 is shown associated with a railroad track shown at 12. The track includes a rail 14 coupled to ties 16 which are set in ballast shown at 18. The railroad rolling stock 10 includes at least one truck comprised of two wheels 20 and 22 associated with axles 24 and 26 respectively. The wheels 20 and 22 are journaled with respect to axles 24 and 26 by means of wheel bearings situated within housings 30 and 32.

In accordance with the prior art, a hot box detector 34 is provided which scans the temperature of the wheel bearings situated within housing 30 to determine whether that wheel bearing is operating in an overheated condition. As shown in FIG. 1 the hot box detector 34 is known as a rail-mounted hot box detector because it is located immediately adjacent to the rail 14. Those skilled in the art Will understand that hot box detectors of the general type shown in 34 may also be mounted outboard from the rail 14 in the ballast 18. Such hot box detectors are known as ballast-mounted detectors. The hot box detector shown in FIG. 1 is of a type, for example manufactured by Servo Corporation of America of Hicksville, N.Y. Typical prior art patents directed to such hot box detectors are U.S. Pat. Nos. 3,454,758 entitled Hot Box Detector and 4,659,043 - Railroad Hot Box Detector. As set forth in these and other prior art patents, hot box detectors employ beams of infra-red radiation such as shown at 36 which are directed to the housing 30 and which are designed to sense the temperature of a bearing situated within such housings. Hot box detectors of the type shown in 34 are coupled to telemetry units at which the sensed temperature of the wheel bearings are analyzed and, if a hot bearing condition is found to exist, such information is transmitted to the locomotive engineer.

The present invention is directed to an apparatus for verifying the proper operation of hot box detectors such as shown at 34 irrespective of whether such detectors are rail-mounted or ballast-mounted.

As can be seen from FIG. 1, the hot box detector 34 is designed to sense the temperature of a wheel bearing of rolling stock 10 as that rolling stock moves in the direction of arrow 38. For purposes of clarity that direction will be referred to herein as the leading direction. As can be seen from FIG. 1, the scanning device of the hot box detector 34 is angled to as to sense the temperature of wheel bearings moving in the leading direction. Because of the angle of incidence with respect to the housing 30 of the infra-red radiation 36 emanating from the hot box detector 34, the hot box detector 34 cannot sense hot bearings if the rolling stock is moving in a direction opposite to that shown in arrow 38, i.e., when the rolling stock is moving in the trailing direction.

As set forth above, it would be desirable to provide an apparatus for verifying the operation of hot box detectors from a rolling carriage irrespective of whether the carriage was traveling in the leading or trailing direction with respect to such detectors.

Figure 2:
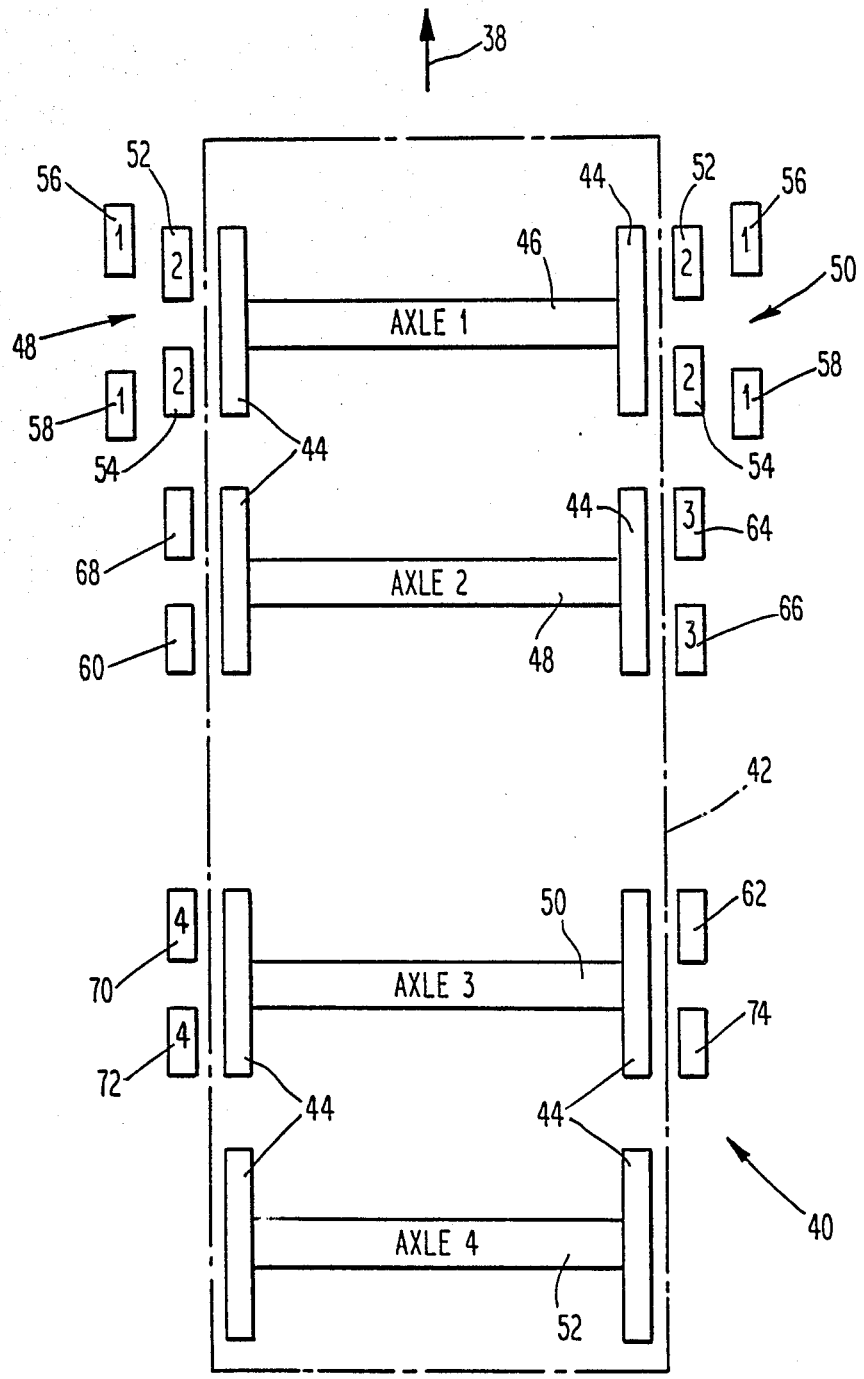
FIG. 2 is a schematic view of the apparatus of the present invention which is utilized to dynamically simulate the wheel bearings of the type shown in FIG. 1.

Referring now to FIG. 2 the present invention will be described in further detail. FIG. 2 is schematic diagram of an apparatus shown generally at 40 for dynamically simulating the presence of a hot bearing on railroad rolling stock. The apparatus comprises a moveable carriage 42 which is designed to roll along railroad track 12. The moveable carriage 42 is supported on railroad wheels 44 which are supported by a plurality of axles. As shown in FIG. 2 four axles are provided including the first axle 46, a second axle 48, a third axle 50 and a fourth axle 52. The carriage is designed to move along the track 12 in the primary or leading direction shown by arrow 38 although the carriage may also move in a direction opposite to arrow 38, i.e., in the trailing direction. With the leading direction 38 as a reference, it will be seen that the apparatus 40 includes both left and right heater means 48 and 50 associated with the first axle 46. The left heater means 48 is associated with the first axle 46 for simulating a hot bearing left side of that axle. The right heater means 50 is also associated with the first axle and simulates a hot bearing on the right side of the axle. Each of the left heater means and right heater means, 48 and 50, includes a first heater 52 for simulating a bearing traveling in the leading direction and a second heater 54 for simulating a bearing traveling in the trailing direction. Each of the left heater means and right heater means 48 and 50 also include a third and fourth heater 56 and 58 situated outboard of the first and second heaters 52 and 54 respectively. The third heaters 56 simulate a bearing traveling in the leading direction whereas the fourth heaters 58 simulate a bearing traveling in the trailing direction. The third and fourth heaters 56 and 58 are situated outboard of the first and second heaters 52 and 54 and are utilized to simulate hot bearings which are sensed by ballast-mounted rather than rail-mounted detectors.

Also as shown in FIG. 2 the means for sensing ambient temperature is provided. In the preferred embodiment the means for sensing ambient temperature includes a first temperature sensor 60 located at one end of the second axle 48 and a second temperature sensor 62 located at an opposite end of the third axle 50. In accordance with the present invention each of the temperature sensors 60 and 62 comprise resistent temperature sensors. Also shown in FIG. 2, situated adjacent the right side of the second axle 48, are right heaters 64 and 66. Right heater 64 simulates a right side hot bearing of the second axle traveling in the leading direction whereas right heater 66 simulates a hot bearing of the same axle when traveling in a trailing direction. Situated adjacent the left end of the second axle 48 is a shield 68 the purpose of which will be explained more fully below.

Situated adjacent the left end of the third axle 50 are left heaters 70 and 72. Left heater 70 simulates a hot bearing on the left side of the third axle 50 when traveling in the leading direction whereas left heater 72 simulates a hot bearing on the left side of the third axle 50 when the carriage is traveling in the trailing direction. A shield 74 is situated adjacent the right end of the third axle 50.

Figure 3:
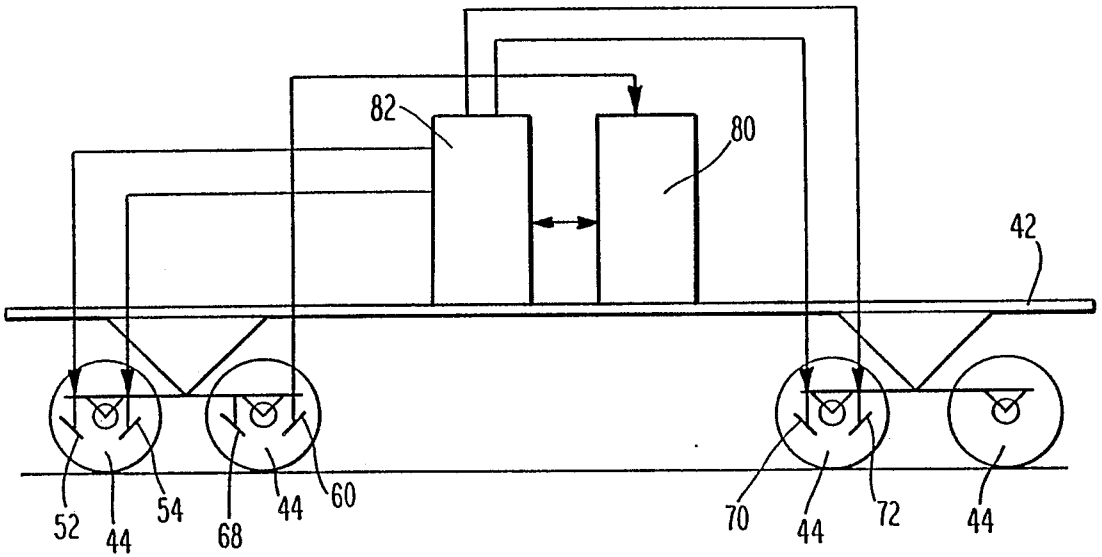
FIG. 3 is a side view of the moveable carriage of the present invention.

Referring now to FIG. 3 it will be seen that the output of the temperature sensor 60 and also the output of temperature sensor 62, not shown, are directed to a computer 80 carried on the moveable carriage 42. The computer 80 provides a means for determining the average temperature sensed by the temperature sensors 60 and 62 so as to provide an ambient temperature reference which is the average of the temperatures sensed o the left and right sides of the carriage. The computer 80 is couple to an onboard temperature controller 82 also carried by the moveable carriage 42. The temperature controller 82, is coupled to each of the respective heaters 52, 54, 70 and 72. The temperature controller 82, of course, is also connected to the additional heaters 56, 58, 64, 66 and 74, although for the purposes of clarity such as not shown in FIG. 3.

In accordance with an important aspect of the present invention each of the heaters 52, 54, 56 and 58 are maintained by the temperature controller 82 at a first predetermined temperature of above about 170° F. above the average ambient temperature as sensed by temperature sensor 60 and 62. In the preferred embodiment, it has been found that each of these heaters should be maintained at a temperature of about 200°–201° F. above the average ambient temperature thus determined. When these heaters are maintained at the appropriate temperature, i.e. above the first predetermined temperature, the apparatus of the present invention simulates the presence of a hot bearing so as to verify that the hot box detectors, be they rail-mount or ballast-mount, are appropriately operated in the absolute mode.

It is also been ascertained that in addition to tripping when the absolute temperature of a passing wheel bearing exceeds a first predetermined temperature above ambient temperature, hot box detectors are also designed to trip whenever the differential temperature between a wheel bearing on the left side of a railroad car exceeds a second predetermined amount with respect to the temperature of the wheel bearing on the right side of the same car, or vice versa. In order to verify that the aforementioned mode of operation of a hot box detector is working appropriately the present apparatus employs heaters 64 and 66 located at the right side of the second axle 48 as well as heaters 70 and 72 located on the left side of the third axle 50. In accordance with this aspect of the present invention heaters 64 and 66 are coupled to the temperature controller 82 and are maintained at a second predetermined temperature, preferably 140° F., above the ambient temperature determined by the first temperature sensor 60. Likewise, heaters 70 and 72 are maintained at a temperature of 140° F. above ambient temperature sensed by the second temperature sensor 62. In this manner the heaters 64 and 66 simulate a wheel bearing on the right side of the second axle which is 140° F. hotter than a wheel bearing operating at ambient on the left side of the second axle 48. Thus the second axle 48 provides a simulation of a right wheel bearing running hotter by 140° F. than a left wheel bearing on the same axle.

Likewise, heaters 70 and 72 are coupled to the temperature controller 82 and are maintained at a temperature of 140° F. above the ambient temperature as determined by the second temperature sensor 62. In this manner the heaters 70 and 72 simulate a situation in which the left bearing is running 140° F. hotter than a right bearing on the same axle.

Shield 68 is provided so as to block the left wheel bearing on the second axle 48 from the line of sight of a hot box detector such that a passing hot box detector will consider that the left wheel bearing of the second axle 48 is operating in ambient when the carriage is moving in the leading direction. The shield 74 is provided so as to block the line of sight of a hot box detector from observing the actual temperature of the right side wheel bearing and axle 50 when the carriage 42 is traveling in the trailing direction. Each of the shields 68 and 74 thus insure that when operating in the differential temperature mode the temperature of the left or right wheel bearings are compared against ambient to verify that hot box detectors are working properly if the difference between the left and right side exceeds 140° F. Without the presence of shields 68 and 74 an actual hot bearing on the left side of the second axle 48 or the right side of the third axle 50 could introduce an error into the desired simulation because the simulated difference in temperature would be less than 140° F.

While the above description of a preferred embodiment of this invention has been disclosed it will be understood that modification may be made without departing from the scope of the invention as defined in the claims which follow.

We claim the following:

1. An apparatus for dynamically simulating the presence of a hot bearing on railroad rolling stock in order to verify that a hot box detector is operating properly to detect a difference in temperature between a wheel bearing at one axle end and a wheel bearing at another axle end comprising:

a movable carriage having a plurality of axles each parallel to the other;

a first temperature sensor mounted proximate to one axle end for determining ambient temperature;

a second temperature sensor mounted proximate to another axle end for determining ambient temperature;

right heater means associated with said one axle end for simulating a hot bearing on the right side of said one axle;

means for controlling the temperature of said right heater means to a predetermined temperature above ambient, the difference between said predetermined temperature and said ambient temperature being greater than the differential trip temperature of the detector but less than the absolute trip temperature of the detector;

left heater means associated with said another axle and for simulating hot bearing on the left side of said another axle; and means for controlling the temperature of said left heater means to said predetermined temperature above ambient, the difference between said predetermined temperature and ambient temperature being greater than the differential trip temperature of the detector but less than the absolute trip temperature of the detector.

2. An apparatus for dynamically simulating the presence of a hot bearing on railroad rolling stock in order to verify that a hot box detector is operating properly to detect a difference in temperature between a wheel bearing at one axle end and a wheel bearing at another axle end comprising:

a moveable carriage having a plurality of axles each parallel to the other;

heater means associated with said one axle end for simulating a hot bearing;

a first temperature sensor mounted proximate to said another axle end for determining ambient temperature; and means for controlling the temperature of said heater means to a predetermined temperature above ambient, the difference between said predetermined temperature and ambient temperature being greater than the differential trip temperature of the detector but less than the absolute trip temperature of the detector.

3. The apparatus of claim 1 wherein said predetermined temperature is about 140° F.

4. The apparatus of claim 3 wherein a shield is provided on the left side of said one axle end and on the right side of said another axle end whereby the wheel bearings at said locations are shielded from the scanners of hot box detectors whose operation is being verified.

5. The apparatus of either of claims 1 or 2 in which the predetermined temperature is about 140° F.

* * * * *